US009089214B2

(12) United States Patent
Kelly et al.

(10) Patent No.: US 9,089,214 B2
(45) Date of Patent: Jul. 28, 2015

(54) STORAGE ASSEMBLY WITH ANGLED SUPPORT SURFACES

(75) Inventors: Daniel E. Kelly, Medford, NJ (US); Emerson B. Donnell, Basking Ridge, NJ (US); Kathleen Donnell, legal representative, Basking Ridge, NJ (US); John A. Spadavecchia, Red House, VA (US)

(73) Assignee: Daniel Kelly, Medford, NJ (US)

( * ) Notice: Subject to any disclaimer, the term of this patent is extended or adjusted under 35 U.S.C. 154(b) by 433 days.

(21) Appl. No.: 13/394,285

(22) PCT Filed: Sep. 2, 2010

(86) PCT No.: PCT/US2010/047683

§ 371 (c)(1),
(2), (4) Date: Aug. 30, 2012

(87) PCT Pub. No.: WO2011/028909

PCT Pub. Date: Mar. 10, 2011

(65) Prior Publication Data

US 2013/0037499 A1 Feb. 14, 2013

Related U.S. Application Data

(60) Provisional application No. 61/239,904, filed on Sep. 4, 2009.

(51) Int. Cl.
*A47F 1/12* (2006.01)
*A47B 81/00* (2006.01)

(52) U.S. Cl.
CPC ..... *A47B 81/007* (2013.01); *A47F 1/12* (2013.01)

(58) Field of Classification Search
CPC ..... A47F 1/04; A47F 1/12; A47F 1/121; A47F 1/125; A47F 1/126; A47F 7/28; A47F 7/281; B65D 21/0209; B65D 21/0212; B65D 21/0215; B65D 21/023; B65D 2501/24006; B65D 2501/24019; B65D 2501/24585; B65D 2501/24592; B65D 2501/24598; B65D 2501/24605; B65D 2501/24611; A47B 81/007
USPC ..... 211/59.2, 74; 206/503, 509, 511; 220/509, 516
See application file for complete search history.

(56) References Cited

U.S. PATENT DOCUMENTS 2,919,814 A * 1/1960 Berkowitz ..... 211/74
3,970,199 A * 7/1976 Marschak ..... 211/126.12

(Continued)

FOREIGN PATENT DOCUMENTS

DE 42 14 961 A1 9/1993
DE 20 2006 017766 3/2007

(Continued)

OTHER PUBLICATIONS

International Search Report for International Application No. PCT/US2010/047683 completed Nov. 18, 2010.

(Continued)

*Primary Examiner* — Joshua Rodden
(74) *Attorney, Agent, or Firm* — RatnerPrestia

(57) ABSTRACT

A storage unit including a support structure defining at least one storage area including a support surface to support at least one storable member and an opening to remove the storable member from the storage area. The support surface has an axis that is at an acute angle ø with respect to horizontal.

12 Claims, 21 Drawing Sheets

(56) References Cited

U.S. PATENT DOCUMENTS

| | | | | | |
|---|---|---|---|---|---|
| 4,310,097 | A | * | 1/1982 | Merl | 211/59.2 |
| 4,416,380 | A | * | 11/1983 | Flum | 211/59.2 |
| 4,763,796 | A | * | 8/1988 | Flum | 211/59.2 |
| 4,785,943 | A | * | 11/1988 | Deffner et al. | 211/59.2 |
| 4,785,945 | A | * | 11/1988 | Rowse et al. | 211/59.2 |
| 4,886,171 | A | * | 12/1989 | Spamer | 211/59.2 |
| 4,895,260 | A | | 1/1990 | Ancona et al. | |
| 4,953,719 | A | * | 9/1990 | Spamer | 211/188 |
| 5,577,623 | A | | 11/1996 | Bustos | |
| 5,706,956 | A | * | 1/1998 | Headrick et al. | 211/59.2 |
| 6,142,300 | A | * | 11/2000 | Kelly et al. | 206/503 |
| 6,186,345 | B1 | * | 2/2001 | Robertson | 211/59.2 |
| 6,431,090 | B1 | | 8/2002 | Davis et al. | |
| 6,811,042 | B2 | * | 11/2004 | Kelly et al. | 211/74 |
| 8,100,273 | B2 | * | 1/2012 | Apps | 211/74 |
| 2002/0043509 | A1 | | 4/2002 | Lajeunesse et al. | |
| 2005/0011843 | A1 | | 1/2005 | Dagan | |
| 2006/0248918 | A1 | | 11/2006 | Robertson | |
| 2007/0206324 | A1 | * | 9/2007 | Donnell et al. | 360/133 |
| 2007/0221593 | A1 | * | 9/2007 | Apps | 211/74 |
| 2008/0083683 | A1 | * | 4/2008 | Apps et al. | 211/74 |
| 2008/0142459 | A1 | * | 6/2008 | Donnell et al. | 211/74 |
| 2011/0089125 | A1 | * | 4/2011 | Roeske | 211/59.2 |

FOREIGN PATENT DOCUMENTS

| | | | | |
|---|---|---|---|---|
| FR | 2 355 485 | | | 1/1978 |
| GB | 2 263 304 | A | | 9/1993 |
| NL | 9202007 | A | * | 6/1994 |
| WO | WO 2005/112710 | | | 12/2005 |
| WO | WO 2009/029066 | A1 | | 3/2009 |

OTHER PUBLICATIONS

Mexican Office Action with English Translation issued in related Mexican Application No. MX/a/2012/002703, dated Jun. 3, 2014.
European Search Report issued in related European Patent Application No. 10 760 489.4, dated May 22, 2013.
European Examination Report issued in related European Application No. 10760489.4, dated Sep. 26, 2014.

* cited by examiner

STORAGE ASSEMBLY WITH ANGLED SUPPORT SURFACES

CROSS-REFERENCE TO RELATED APPLICATIONS

This application is the U.S. National Phase of PCT International Application No. PCT/US2010/047683, filed Sept. 2, 2010, and claims priority to U.S. Application Ser. No. 61/239,904, filed Sep. 4, 2009, the contents of both applications being incorporated by reference in their entireties.

FIELD OF THE INVENTION

This invention relates generally to a rack for storing storable members, such as water bottles, and more specifically to a storage assembly having angled support surfaces.

BACKGROUND OF THE INVENTION

One example of a storable member typically stored and transported in racks is a generally cylindrical water bottle. These water bottles are typically handled, transported, and stored in varying quantities. For easier handling, transport, and storage, the water bottles may be loaded in carriers designed to accommodate multiple bottles. Each carrier defines one or more apertures configured to receive and support the bottles in a horizontal position. To accommodate a larger number of bottles, each aperture is typically configured to receive two bottles, one behind the other. To further accommodate the varying quantities of bottles, aluminum and plastic modular racks are available comprising carriers designed to be vertically stackable. These modular racks are formed by stacking bottle storage units or carriers to define a rack approximately six feet or more in height.

Once a rack is assembled in a delivery truck, the upper storage units or carriers are often at a height equal to the height of the delivery truck. As such, the delivery person must reach to access the storable members or bottles in the upper storage units or carriers. Such access is difficult, and potentially dangerous, particularly for the bottles that are stored rearwardly in the storage unit aperture.

To overcome the shortcomings of existing modular racks, a need exists for a storage rack that provides a reliable assembly to ease access to storable members stored in a rearward position within the rack apertures.

SUMMARY OF THE INVENTION

To meet these and other needs, and in view of its purposes, an exemplary embodiment of the present invention provides a storage unit comprising a support structure defining at least one storage area including a support surface to support at least one storable member and an opening to remove the storable member from the storage area. The support surface has an axis that is at an acute angle ø with respect to horizontal.

In another aspect of the invention, the present invention provides a storage unit comprising a support structure defining at least one storage area including a support surface to support at least one storable member and an opening to remove the storable member from the storage area. The opening extends in a plane at an acute angle $\alpha$ with respect to an axis of the support surface.

It is to be understood that both the foregoing general description and the following detailed description are exemplary, but are not restrictive, of the invention.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawings are the following figures.

DETAILED DESCRIPTION OF THE INVENTION

Figure 1:
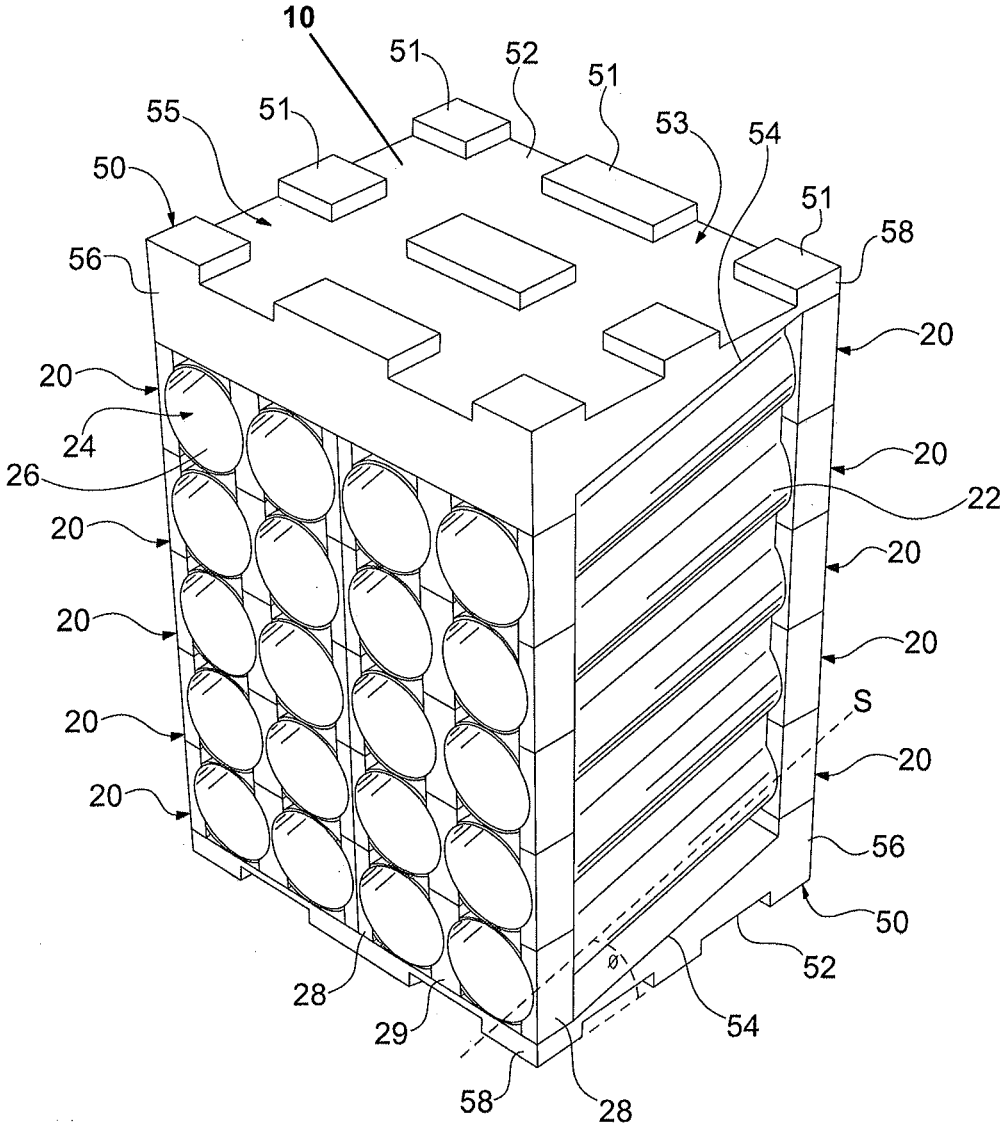
FIG. 1 is a front isometric view of a storage assembly according to a first exemplary embodiment of the present invention.

Referring now to the drawings, in which like reference numbers refer to like elements throughout, FIG. 1 shows a storage assembly 10 according to a first exemplary embodiment of the present invention. The storage assembly 10 of the present embodiment is preferably configured to store storable members in an laid down or horizontal orientation as shown in the figures. That is, the storable members are oriented with their largest dimension laid down parallel to the support surface or horizontal.

The storage assembly 10 is described as a modular structure comprising a plurality of storage units 20. Each storage unit 20 holds a plurality of water bottles or other storable members (not shown), and is configured to be interlocked with an underlying storage unit 20 or with a frame unit 50. While the present invention is described with respect to modular, stackable storage units 20, the present invention may be embodied as a unitized storage rack having multiple storage apertures defined within a single frame structure or housing. The storage units 20 of the present embodiment of the invention enhance the accessibility to storable members within the storage apertures 24.

When used herein, the following words and phrases have the meaning provided. Front shall indicate the storage assembly front surface and rear shall indicate the storage assembly rear surface. Forward shall indicate toward the front surface and rearward shall indicate toward the rear surface. Left and right shall indicate the directions when looking at the storage assembly front surface. Up, upper, upward, above, down, lower, downward, below, underlying, and the like indicate the directions relative to the front surface as shown in FIG. 1. Longitudinal indicates the axis extending from the front surface to the rear surface. Lateral and latitudinal indicates the direction between the left and right sides of the storage assembly.

Referring to FIGS. 1-6, the storage assembly 10 will be described in greater detail. In the present embodiment, the storage assembly 10 generally includes a plurality of stacked storage units 20 supported between upper and lower frame units 50. Each storage unit 20 of the present exemplary embodiment includes a pair of storage tubes 22 configured to receive storable members. Each storage unit 20 may have more or fewer storage tubes 22. Each storage tube 22 includes a front opening 24 configured to allow dispensing of the storable members out of the storage tube 22.

Figure 2:
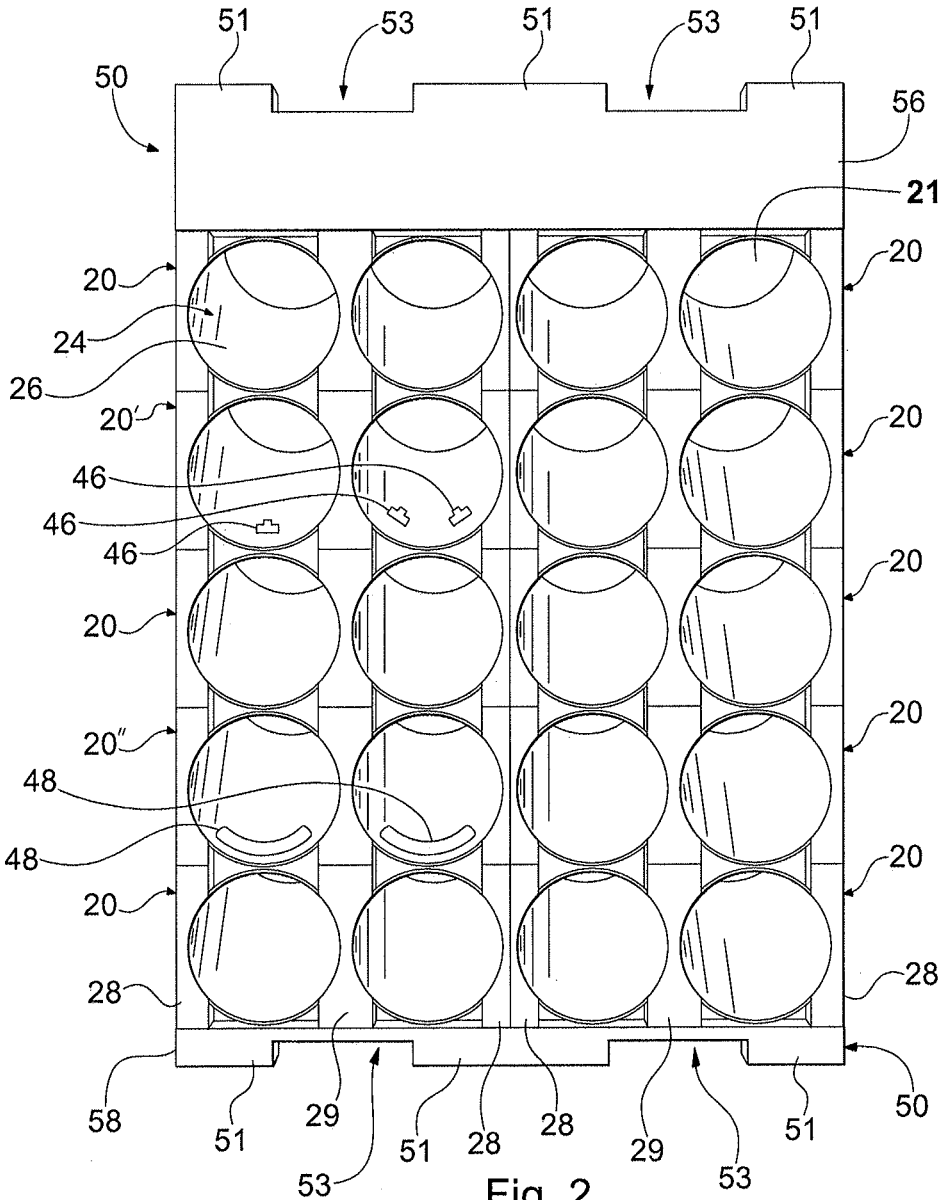
FIG. 2 is a front elevation view of the storage assembly of FIG. 1.
Figure 4:
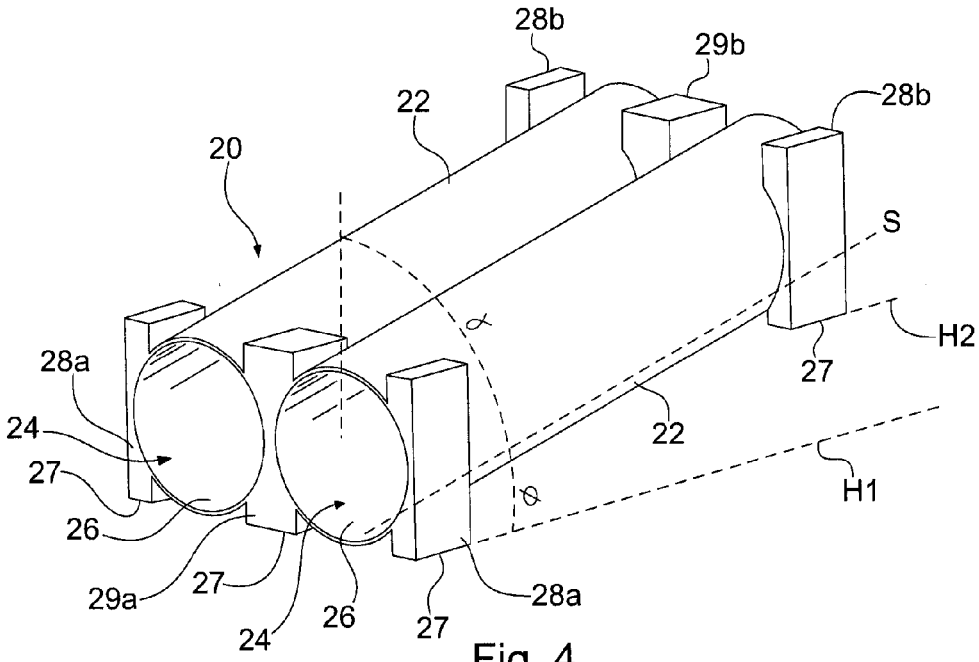
FIG. 4 is a front isometric view of an exemplary storage unit of the storage assembly of FIG. 1.

Referring to FIG. 4, an exemplary storage unit 20 will be described in more detail. Each storage unit 20 includes one or more support tubes 22 supported by support posts 28, 29. In the present embodiment, a pair of support tubes 22 are supported by respective external posts 28 and a common central post 29 at both the front and rear of the tubes 22. Other numbers and configurations of posts may also be utilized. Each tube 22 defines a front opening 24 configured to receive generally cylindrical storable members, such as water bottles. As shown in FIG. 2, each storage tube 22 desirably has a rear opening 21 which minimizes weight and may facilitate rear loading of the support tube 22. Each support tube 22 defines a support surface 26 upon which the storable members are supported. In the present embodiment, the support tubes 22 are continuous cylinders with a lower portion of each cylinder defining the support surface 26. Configurations other than continuous cylinders may be utilized. For example, each tube 22 may have openings or the like therealong to facilitate access within the tube 22 and to reduce weight and increase visibility. Alternatively, each tube 22 may be defined by a series of interconnected rails or the like.

Referring again to FIGS. 1-6, assembly of the modular storage assembly 10 of the present embodiment of the invention will be described. As set forth above, while this exemplary embodiment of the invention is modular, the invention is not limited to such.

Figure 5:
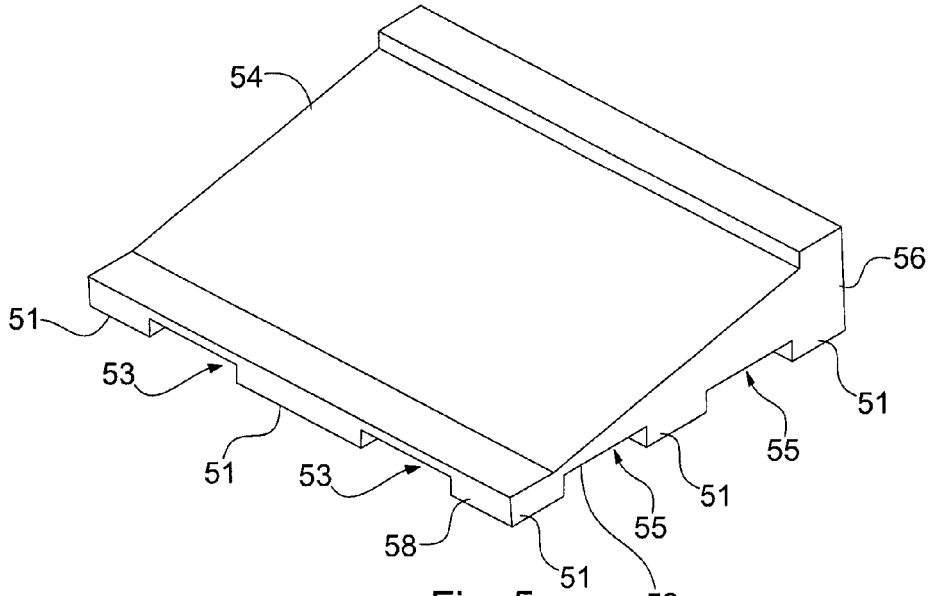
FIG. 5 is a front isometric view of an exemplary frame unit of the storage assembly of FIG. 1.

FIG. 5 illustrates an exemplary frame unit 50 of the storage assembly 10. In this embodiment, the lower base and top structure of the storage assembly 10 utilize the same frame unit 50, inverted relative to one another. Such simplifies manufacturing, but is not required. The frame unit 50 has a base surface 52 extending between a rear rail 56 and a front rail 58. A plurality of feet 51 extend from the base surface 52 and may be a continuation of either the rear or front rail 56, 58. The feet 51 are sized and positioned such that longitudinal and lateral channels 53 and 55 are defined. These channels 53, 55 are configured to receive forklift tines or the like to facilitate lifting and positioning of the storage assembly 10.

Figure 3:
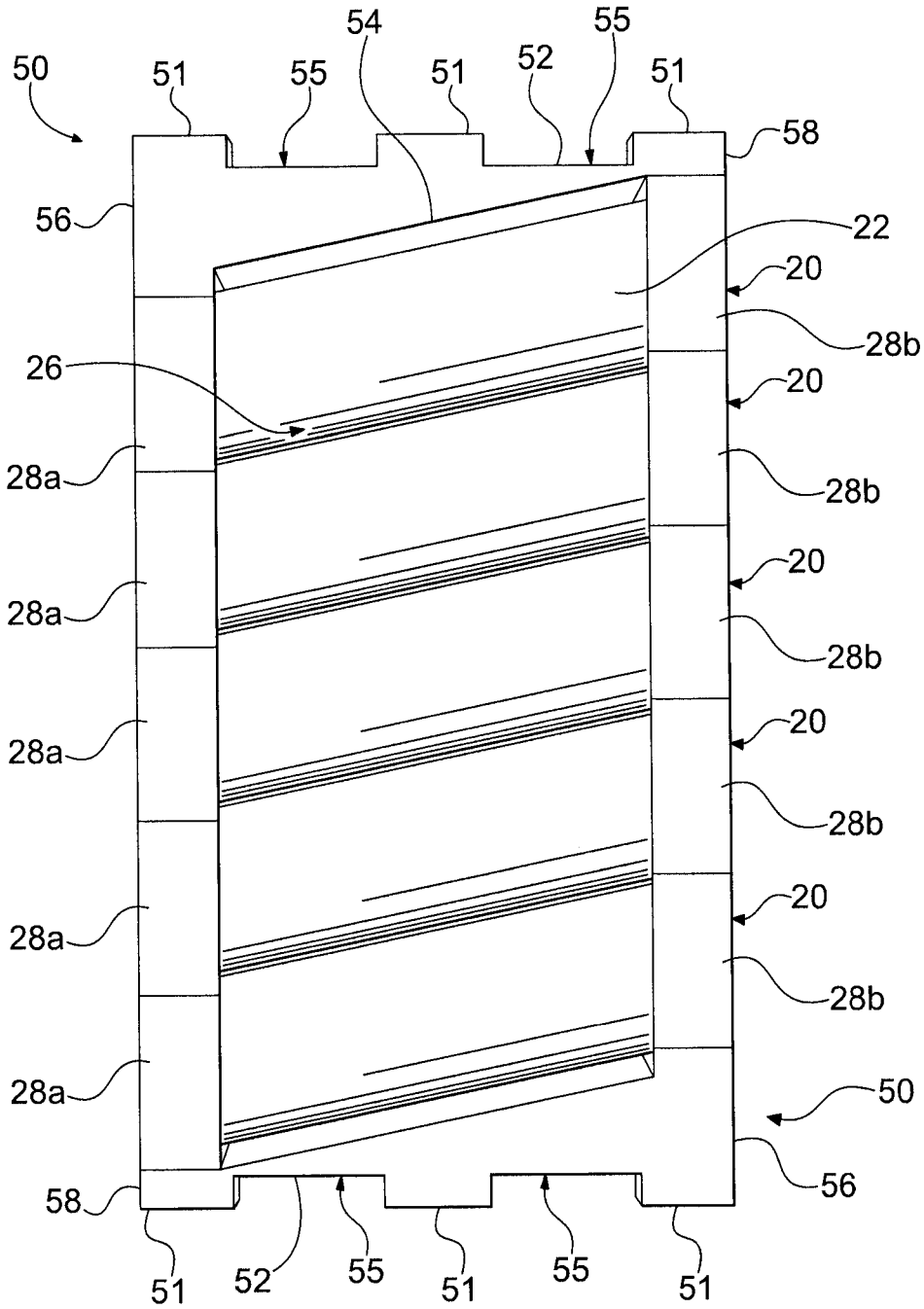
FIG. 3 is a side elevation view of the storage assembly of FIG. 1.

The rear rail 56 has a height greater than the height of the front rail 58 with the heights desirably a function of the intended angle ø of the support surfaces 26. An angled base surface 54 extends between the rails 56 and 58. Again, the angle of the angled base surface 54 is desirably a function of the intended angle ø of the support surfaces 26. Referring to FIG. 3, the support units 20 are stacked on one of the frame units 50 with the front posts 28*a*, 29*a* supported on the front rail 58 and the rear posts 28*b*, 29*b* supported on the rear rail 56. A second frame unit 50 is inverted and connected to the upper most support unit 20. With the second frame unit 50, the front posts 28*a*, 29*a* engage the rear rail 56 and the rear posts 28*b*, 29*b* engage the front rail 58.

Figure 6:
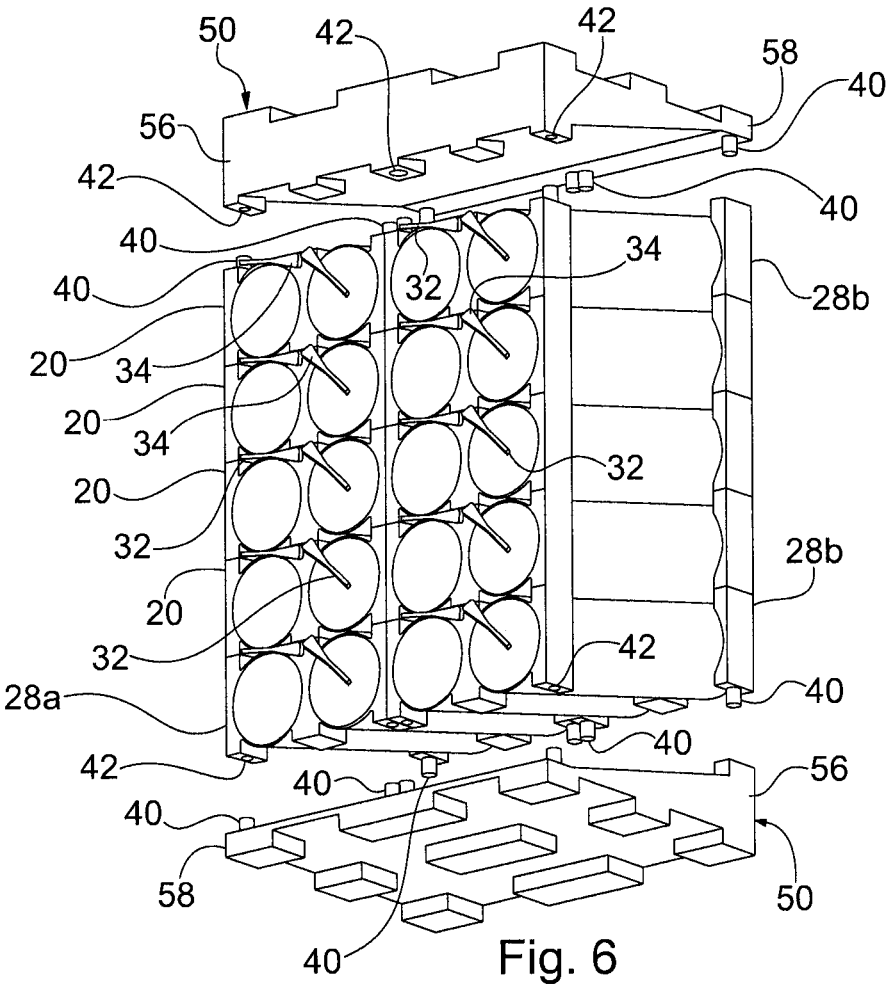
FIG. 6 is an exploded front isometric view of the storage assembly of FIG. 1.
Figure 7:
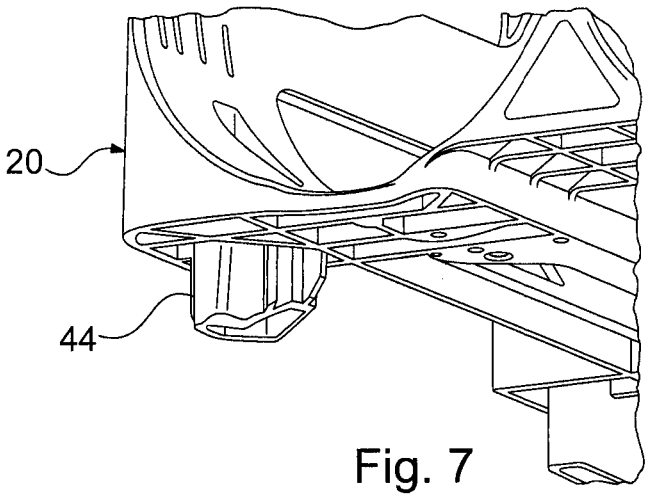
FIG. 7 is an enlarged isometric view of an exemplary foot of the storage assembly of FIG. 1.

Interconnecting mechanisms are desirably provided between the storage units 20 and the frame units 50 and between adjacent storage units 20. Exemplary interconnecting mechanisms in the form of posts 40 are illustrated in FIG. 6. The posts 40 are received in corresponding bores 42 in the opposed structure. In the illustrated exemplary embodiment, along the front surface, the posts 40 extend from a lower structure (i.e., frame 50 or storage unit 20) to a bore 42 in the structure (i.e., frame 50 or storage unit 20) above, while along the rear surface, the posts 40 extend from an upper structure (i.e., frame 50 or storage unit 20) to a bore 42 in the structure (i.e., frame 50 or storage unit 20) below. Similar posts extend between the adjacent storage units 20. The invention is not limited to the number or configuration of the posts 40 shown. Furthermore, the interconnecting mechanisms may have various other configurations such as, but not limited to, interlocking fingers, tongues and grooves, pins, and other configurations. For example, an exemplary contoured foot 44 is illustrated in FIG. 7. The foot 44 is configured to mate with a corresponding bore or the like. The contoured foot 44 may be configured to guide alignment between mating structures.

Referring to FIGS. 1 and 4, the support posts 28 and 29 and the frame units 50 of the present embodiment of the invention are configured such that the support tubes 22 are supported with the axis S of each support surface 26 at an acute angle ø with respect to horizontal. With such an angled support surface 26, the force of gravity assists in moving the storable members toward the front opening 24 of the support tube 22. It is further noted with respect to FIG. 4 that the support surface axis S is also at an acute angle $\alpha$ with respect to the plane in which the front opening 24 extends. The front openings 24 are intended to extend vertically, such that the angle $\alpha$ is equal to 90°minus ø.

In the present embodiment, the lower surface of the base unit feet 51 and the upper surfaces of the rails 56, 58 are substantially parallel to one another. As such, with the lower frame unit 50 positioned on a horizontal surface, for example, in a delivery truck, the upper surfaces of the rails 56, 58 will also extend in horizontal planes. Referring to FIG. 4, the base surface 27 of each of the front support posts 28*a* and 29*a* extend in a first horizontal plane H1 and the base surface 27 of each of the rear support posts 28*b* and 29*b* extend in a second horizontal plane H2 offset from the first horizontal plane H1 a distance equal to the height difference between the rails 56 and 58. As such, when the support assembly 10 is assembled, the support tubes 22 are supported at a desired angle with respect to horizontal. As illustrated in FIGS. 1 and 4, the axis S of each support surface 26 defined by the support tubes 22 is at the angle ø with respect to horizontal. The angle of any of the components, i.e. the lower surface of the feet 51, the upper surfaces of the rails 56, 58 and the base surfaces 27 of the posts 28, 29, may be modified to achieve different angles or to utilized the storage assembly 10 in different applications. For example, if the storage assembly 10 is to be utilized in a truck with a non-horizontal support surface, the angle of the feet 51 may accordingly be modified.

Figure 8:
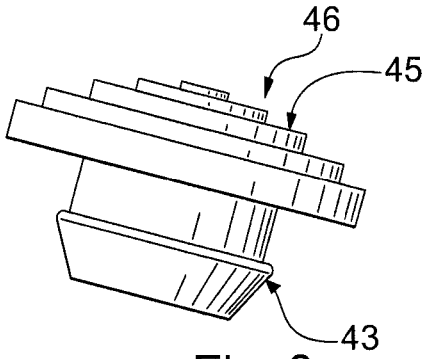
FIG. 8 is an isometric view of an exemplary retaining button.
Figure 9:
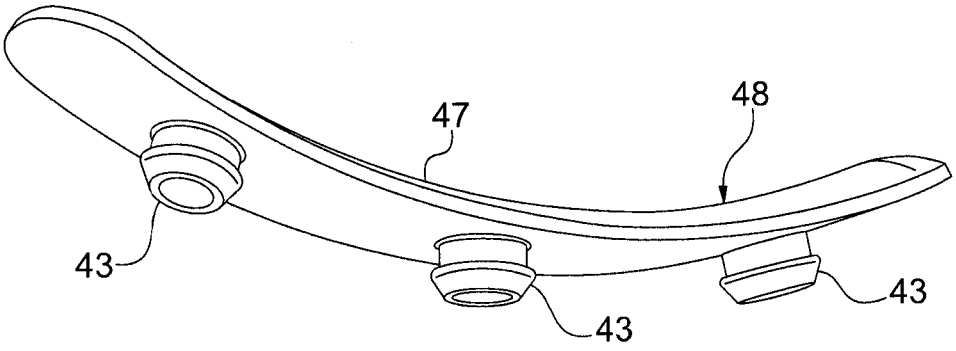
FIG. 9 is an isometric view of an exemplary retaining ridge.

Various mechanisms may be utilized to minimize the likelihood that a storable member may inadvertently move out of its storage tube 22. For example, as shown in FIG. 2, storage unit 20' includes one or more retaining buttons 46 similar to those shown in FIG. 8. Each retaining button 46 includes a retaining portion 43 which extends into a hole in the storage tube 22 spaced a desired distance from the opening 24 of the tube 22 and an engaging portion 45 configured to engage the storable member. As shown in FIG. 2, various number and configurations of buttons 46 may be provided. An operator maneuvers the storable member over the buttons 44 to remove a storable member when desired. Each storage tube 22 of storage unit 20" is shown with a retaining ridge 48, as shown in FIG. 9, provided along the support surface 26 adjacent to the front opening 24. Each retaining ridge 48 has a latitudinally extending body 47 with a plurality of retaining portions 43 extending therefrom and configured to be received in corresponding holes in the storage tube 22. The latitudinally extending body 47 desirably has a contour configuration which complements the shape of the support surface 26. The retaining ridges 48 contact the storable member and block inadvertent forward movement. An operator maneuvers the storable member over the ridge 48 to remove a storable member when desired.

Referring to FIG. 6, each of the storage units 20 is shown with a pair of stop bars 32, each configured to extend across a respective front opening 24. In the closed position, as illustrated in the right side tubes 26, the stop bar 32 extends across all or a portion of the opening 24 to prevent forward movement of the storable member. To remove a storable member, a respective stop bar 32 is pivoted about pivot point 34 to provide unobstructed access to the opening 24, as illustrated in the left side tubes 26. The stop bars 32 may be configured to extend completely across the opening 24 and latch or otherwise hood thereon.

Referring to FIGS. 10-15, an alternative stop mechanism 60 for retaining the storable members will be described. The stop mechanism 60 is provided adjacent to the front opening 24 of a respective storage tube 22. While a single stop mechanism 60 is illustrated with respect to the tube 22, more than one may be utilized. The stop mechanism 60 generally comprises a support body 61 with a stop block 80 moveably retained relative thereto.

Figure 10:
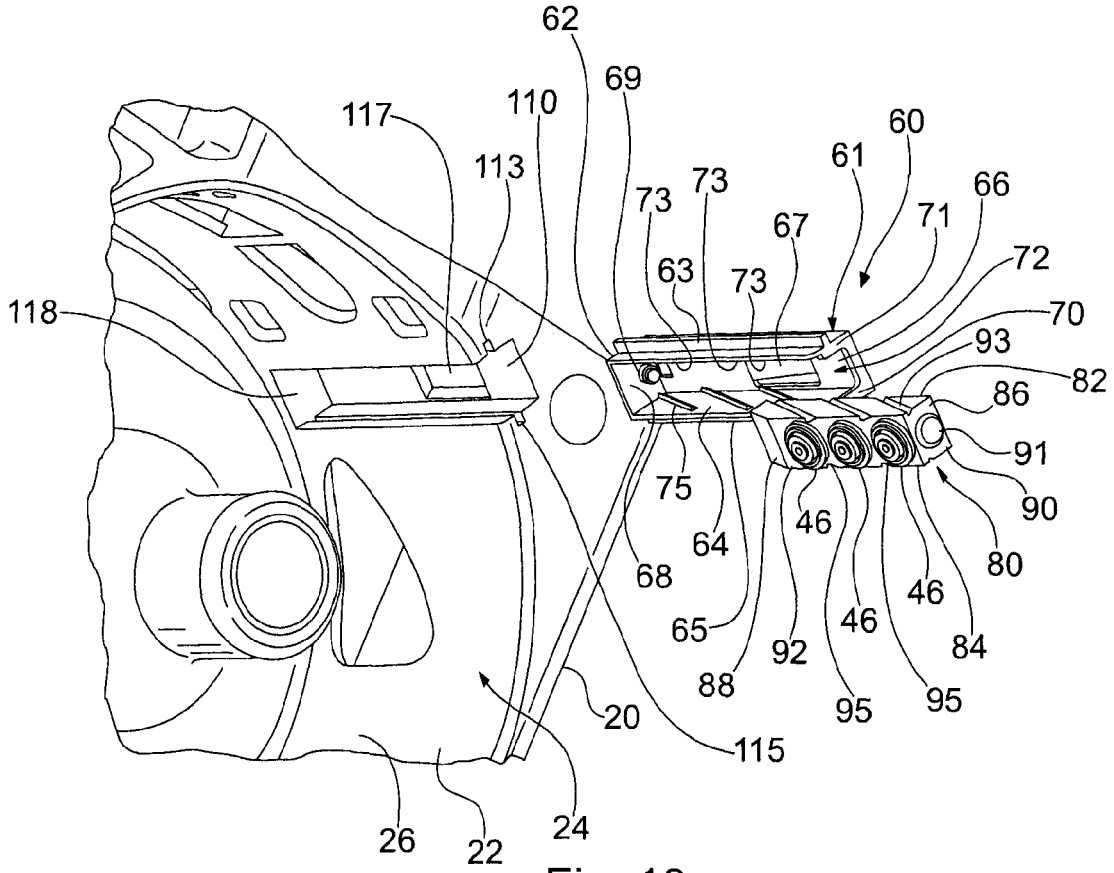
FIG. 10 is a front, bottom isometric view of an exemplary storage unit with a stop mechanism illustrated in exploded form.
Figure 11:
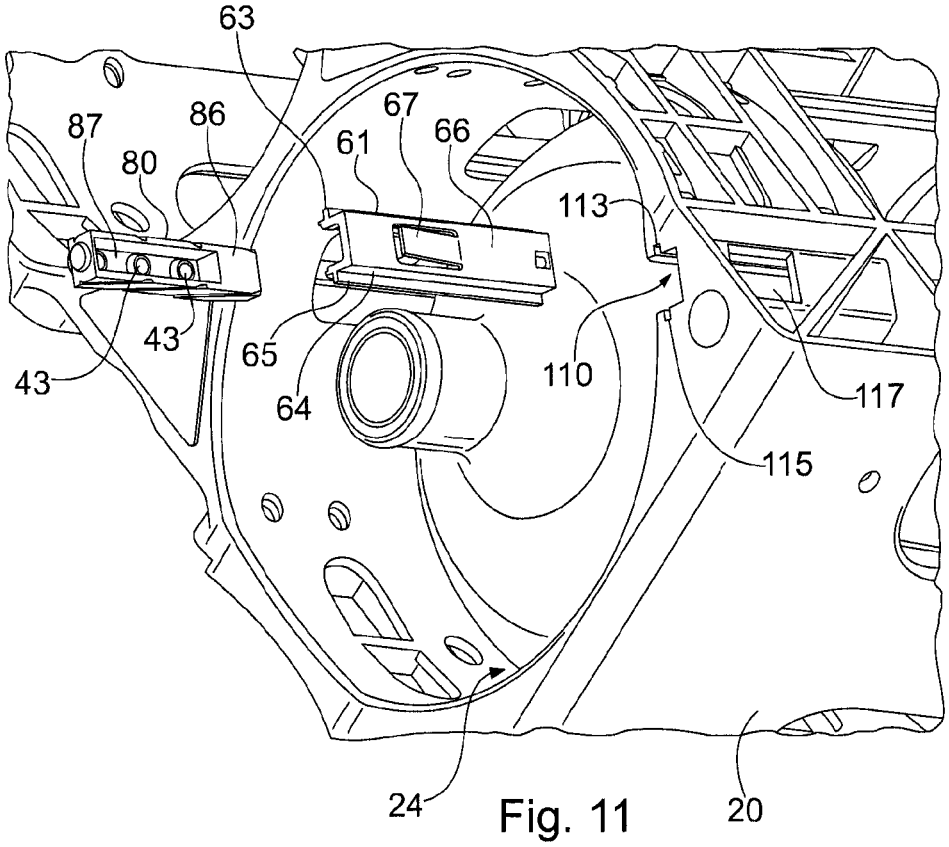
FIG. 11 is a front, top isometric view similar to FIG. 10.
Figure 12:
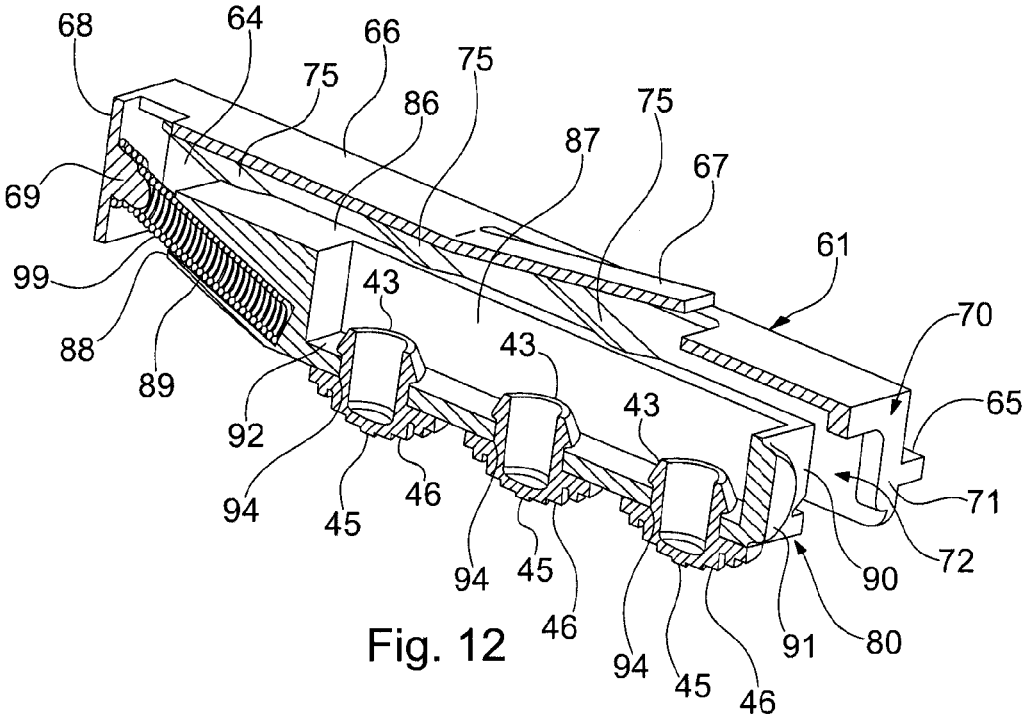
FIG. 12 is a cross-sectional view through the stop mechanism of FIG. 10.
Figure 13:
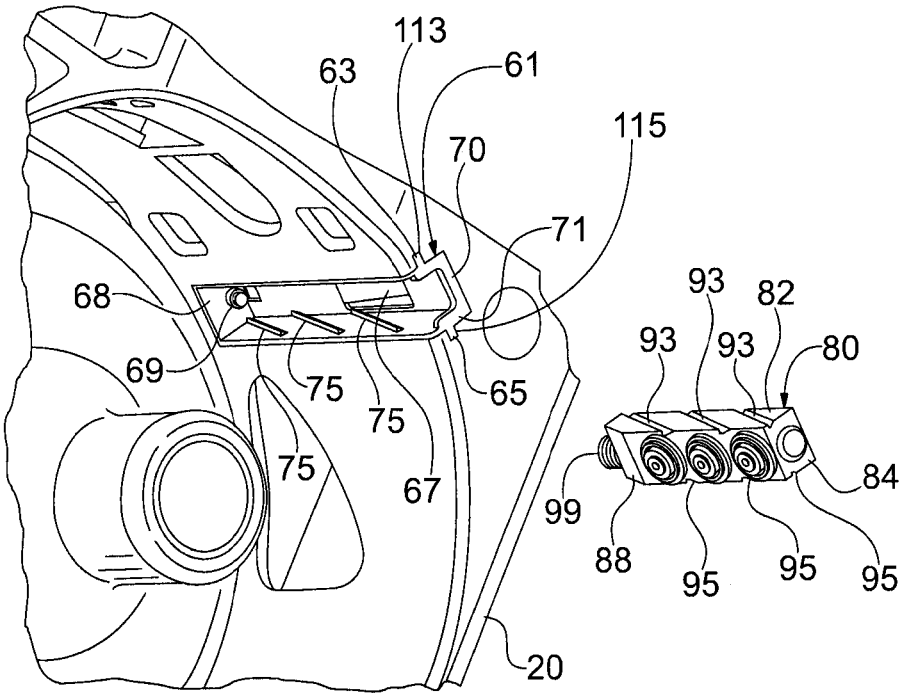
FIG. 13 is an isometric view similar to FIG. 10 with the stop mechanism partially assembled.

With reference to FIGS. 10-12, the support body 61 includes opposed side walls 62 and 64 joined by a top wall 66, a rear wall 68 and a front wall 70. In the present embodiment, the side opposite the top wall 66 is generally open. The support body 61 is configured to be received and retained in a slot 110 formed along the inner surface 26 of the storage tube 22 adjacent to the front opening 24. The slot 110 has an end wall 118 preferably positioned such that when the support body 61 is positioned in the slot 110, the support body front wall 70 is generally flush with the front surface of the storage unit 20 (see FIG. 14), although such is not required. Additionally, the ends of the side walls 62 and 64 are preferably generally flush with the inner surface 26 of the storage tube 22, although such is not required. In the preferred embodiment, a support rail 63, 65 extends from the outside surface of each side wall 62, 64 and is received in a corresponding groove 113, 115 adjacent the slot 110 to radially support the support body 61. An opening 117 is provided along the top of the slot 110 and is configured to receive a projection 67 extending from the top wall 66 of the support body 61. Receipt of the projection 67 in the opening 117 axially fixes the support body 61 relative to the storage unit 20. Other means for radially and axially fixing the support body 61 may alternatively be utilized.

Referring to FIGS. 10 and 12, the inside surfaces of the side walls 62 and 64 include inwardly extending ramps 73 and 75. Each of the ramps 73, 75 extends at an angle rearward and upward into the support body 61. Each ramp 73, 75 is configured to be received in a corresponding groove 93, 95 in the side walls 83, 85, respectively, of the stop block 80. The slide block 80 thereby is supported and guided between a stop position (see FIG. 14) wherein the slide block 80 extends from the support body 61 and a retracted positioned (see FIG. 15) wherein the slide block 80 is retracted substantially within the support body 61. A spring 99 or other biasing means extends between a support 69 on the rear wall 68 of the support body 61 and a slot 89 in the rear surface 88 of the stop block 80. The spring 99 biases the stop block 80 to the stop position.

Figure 14:
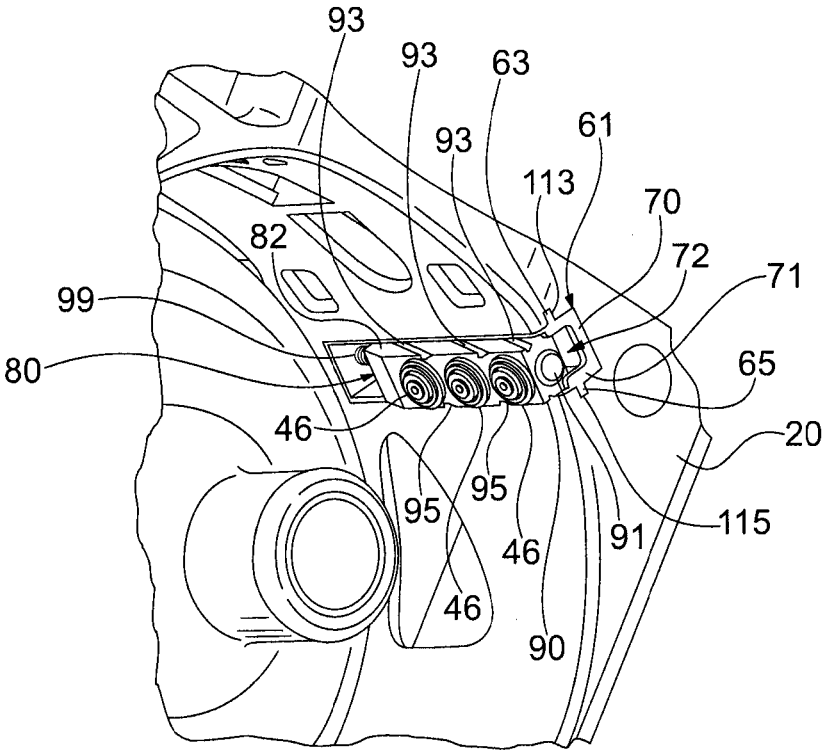
FIG. 14 is an isometric view similar to FIG. 10 with the stop mechanism assembled and in a stop position.
Figure 15:
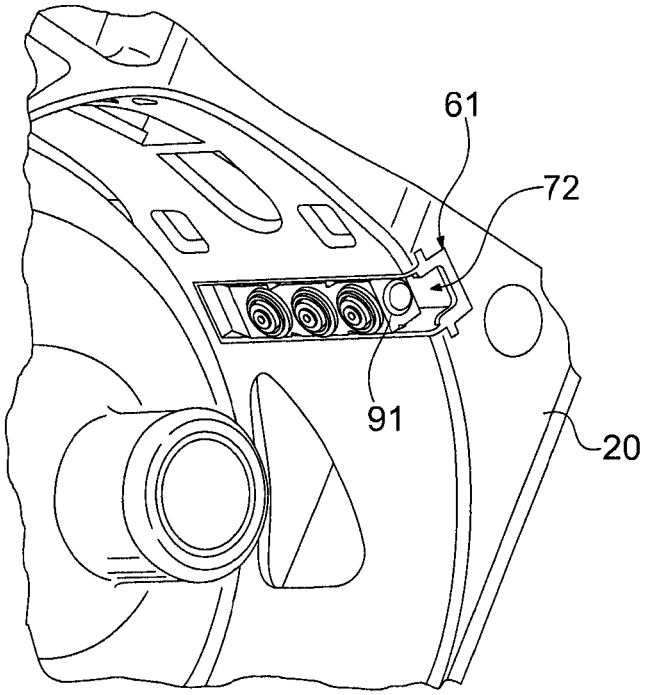
FIG. 15 is an isometric view similar to FIG. 14 with the stop mechanism in a retracted position.

As shown in FIGS. 10, 12 and 14, the front wall 70 of the support body 61 includes an opening 72 such that the wall 70 defines as shoulder 71 about the opening. The shoulder 71 is configured to contact the front wall 90 of the stop block 80 to retain the stop block 80 in the support body 61. A raised button 91 on the front wall 90 is aligned with the opening 72 such that a user may push the stop block 80 to the retracted position as will be described hereinafter. The raised button 91 is not required, but instead a user could simply push on the front wall 90 or the like.

Referring to FIG. 12, the lower wall 92 of the stop block 80 defines one or more apertures 94, three in the illustrated embodiment, configured to receive the retaining portions 43 of respective retaining buttons 46. The top wall 86 of the stop block 80 has an opening 87 aligned with the apertures 94 to simplify manufacturing and allow access to the retaining portions 43 if necessary. The engaging portion 45 of each retaining button 46 is configured to engage the storable member. While retaining buttons 46 as shown in FIG. 8 are utilized in the present embodiment, other contacting elements may be utilized. During storage and transport, the spring 99 biases the stop block 80 to the stop position wherein the retaining buttons 46 contact the storable member. To remove a storable member, an operator pushes the stop block 80 to the retracted position such that the retaining buttons 46 are clear of the storable member and the storable member may be removed from the storage tube 22.

Figure 16:
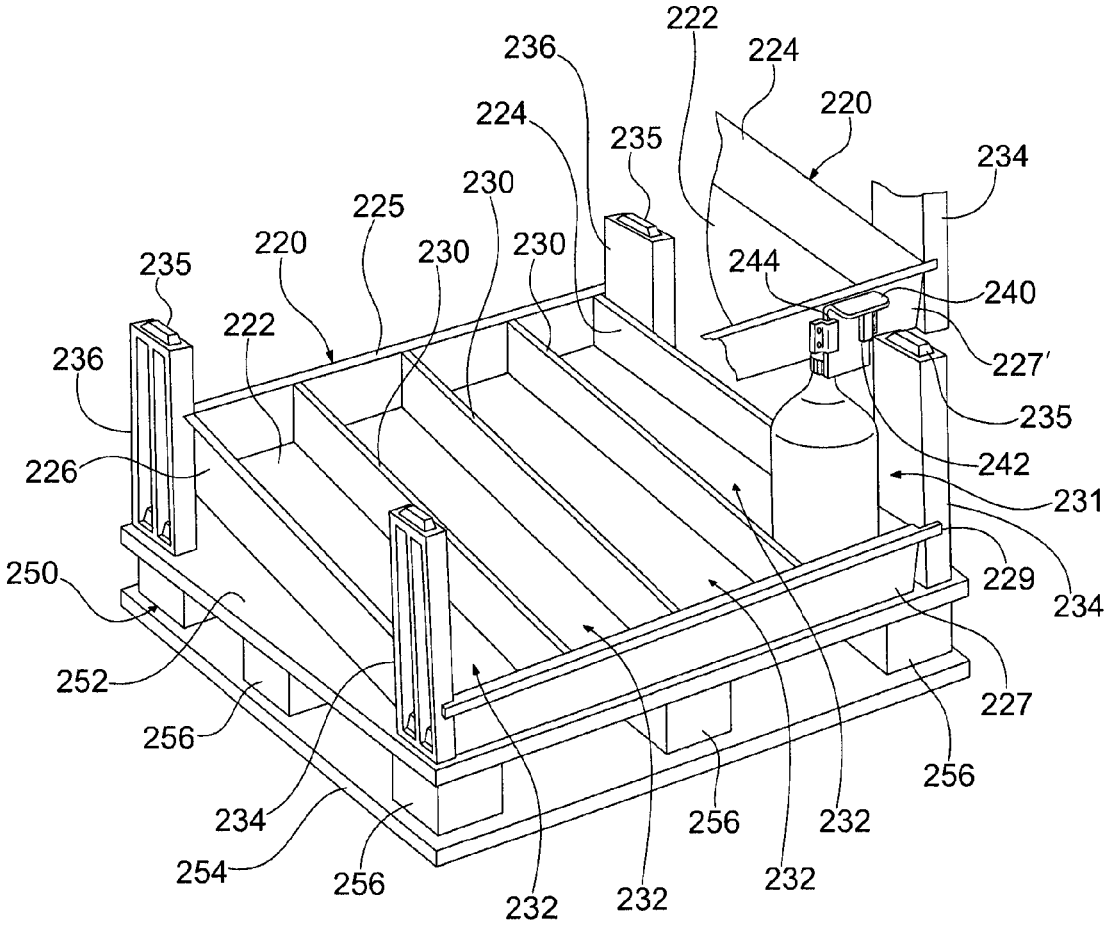
FIG. 16 is an isometric view of a storage assembly according to another exemplary embodiment of the present invention.
Figure 17:
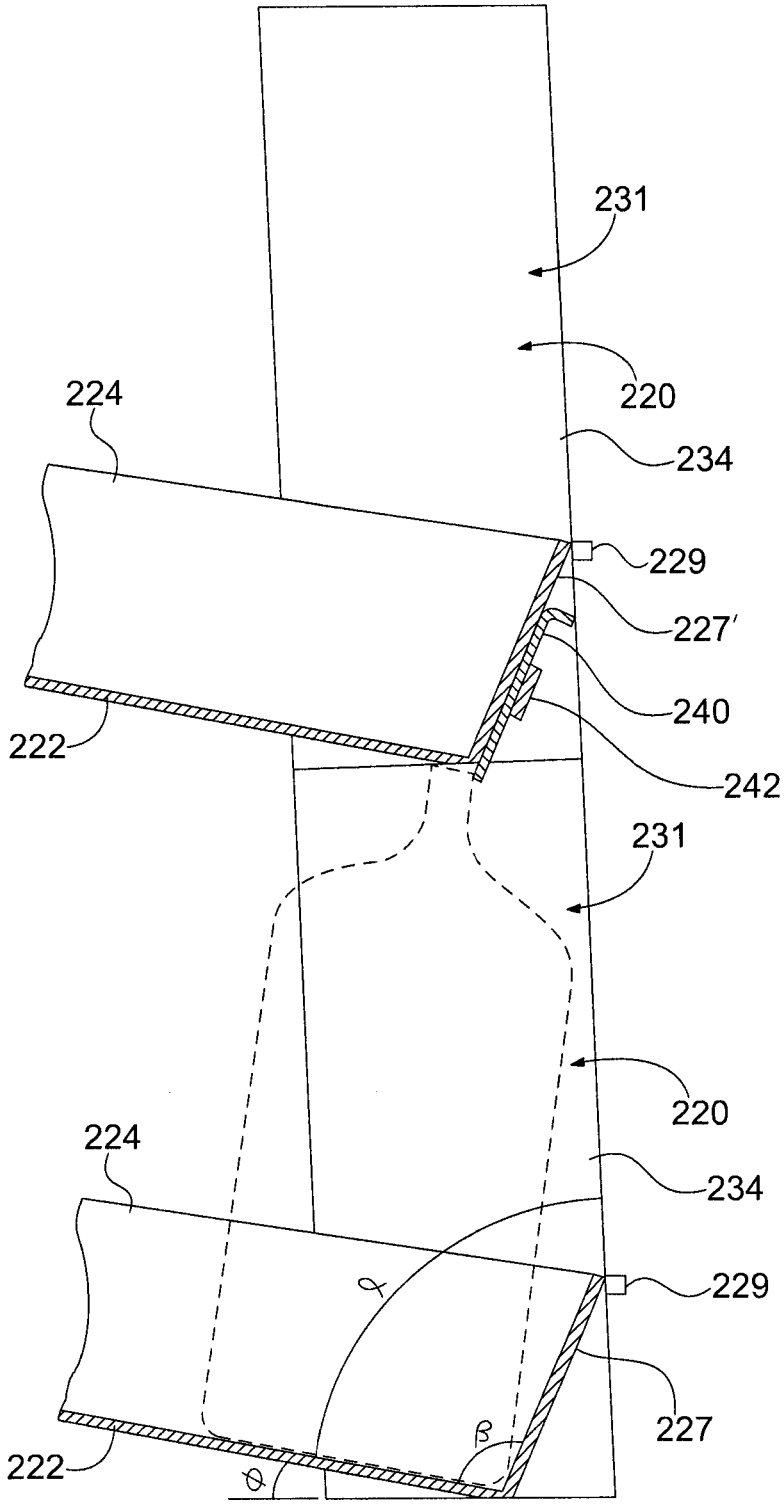
FIG. 17 is a cross-sectional view of a portion of the storage assembly of FIG. 16 with the stop members in a locked position.
Figure 18:
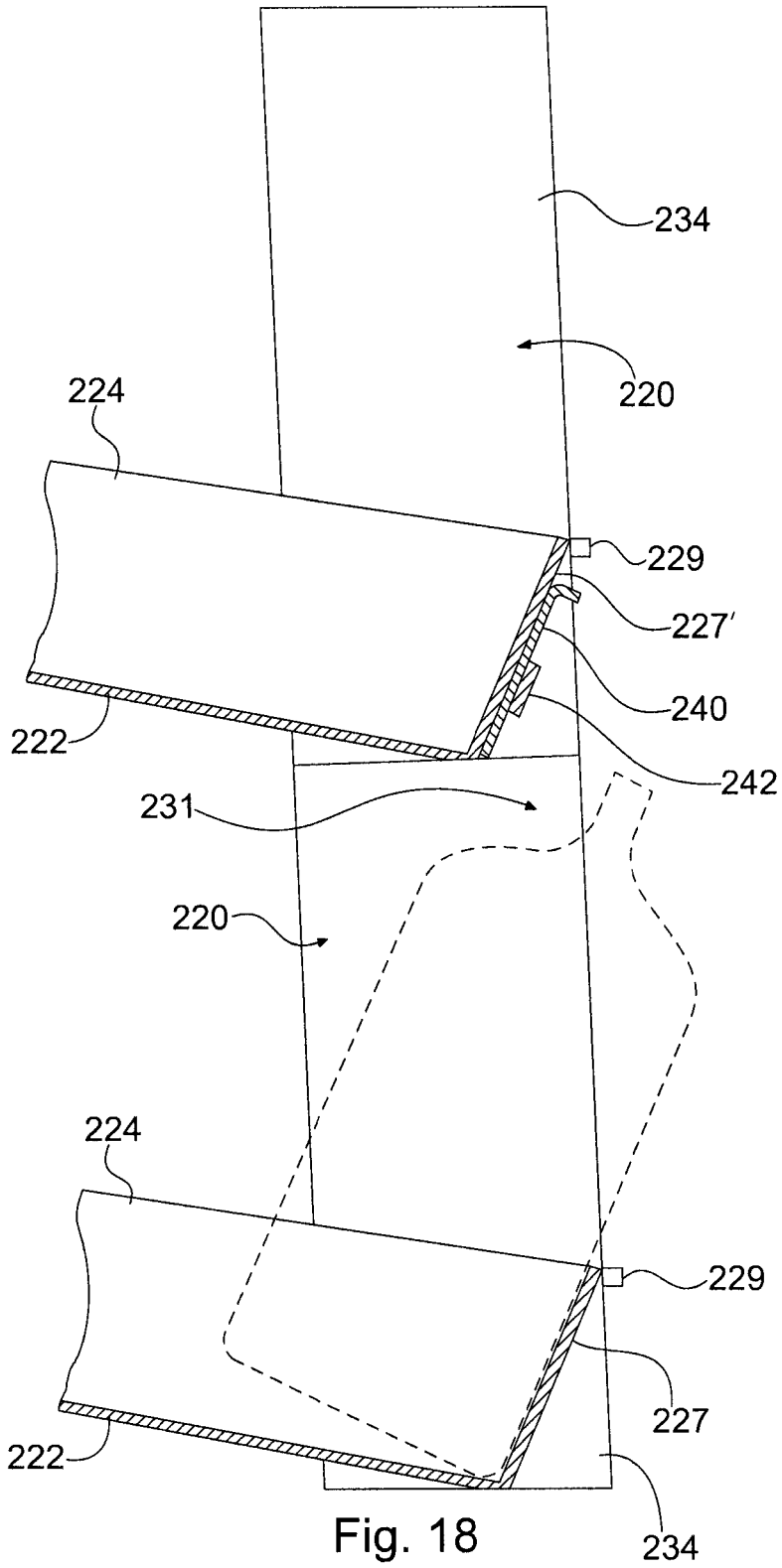
FIG. 18. is a cross-sectional view similar to FIG. 17 with the stop members in an unlocked position.
Figure 19:
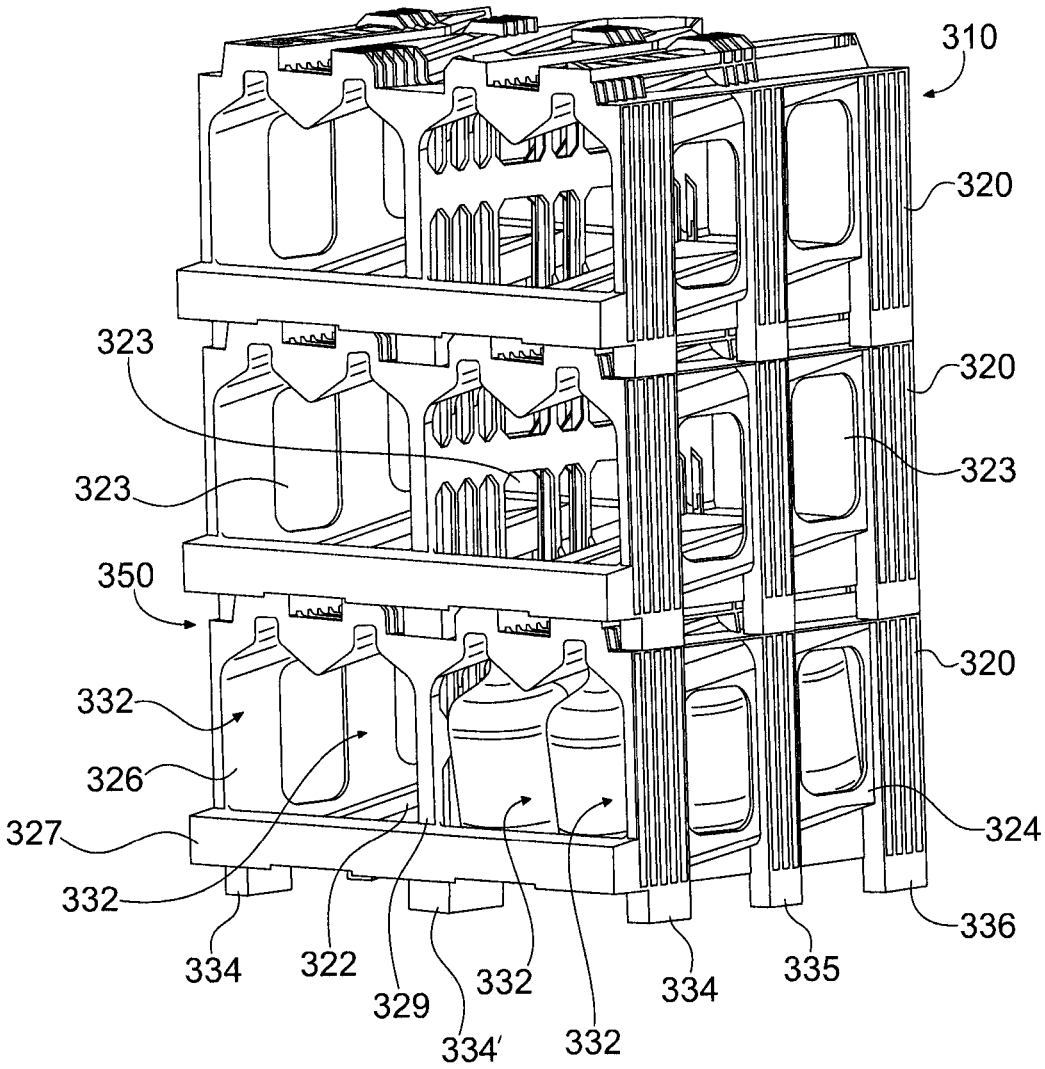
FIG. 19 is a front isometric view of a storage assembly according to another exemplary embodiment of the present invention.
Figure 20:
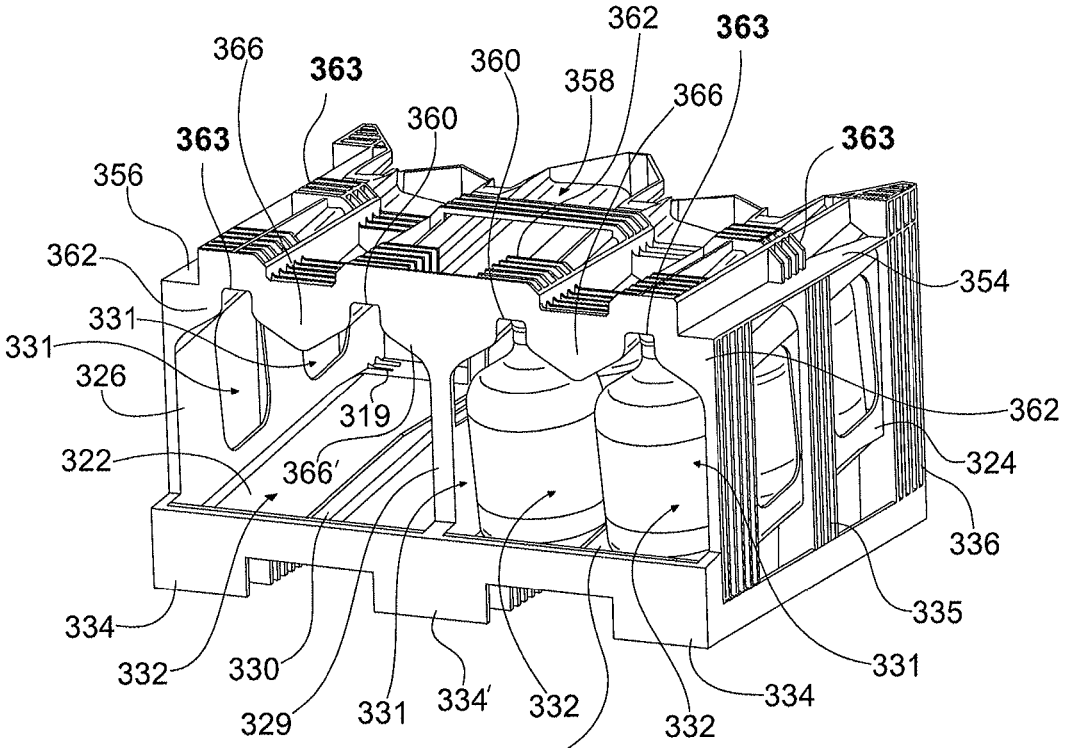
FIG. 20 is a front isometric view of an exemplary storage unit of the storage assembly of FIG. 19.
Figure 21:
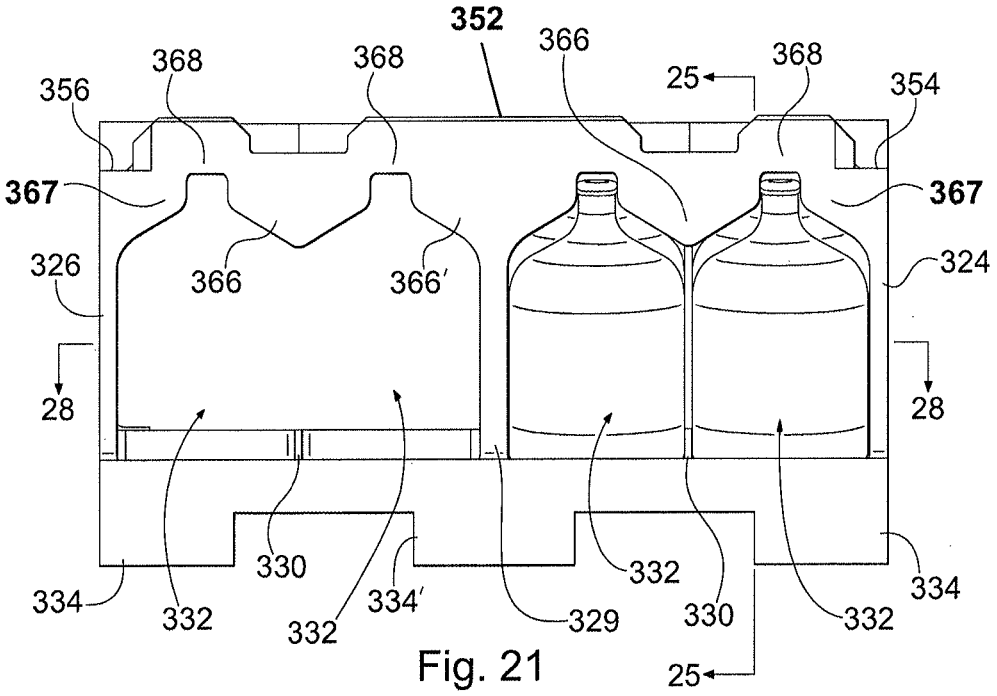
FIG. 21 is a front elevation view of the storage unit of FIG. 20.
Figure 22:
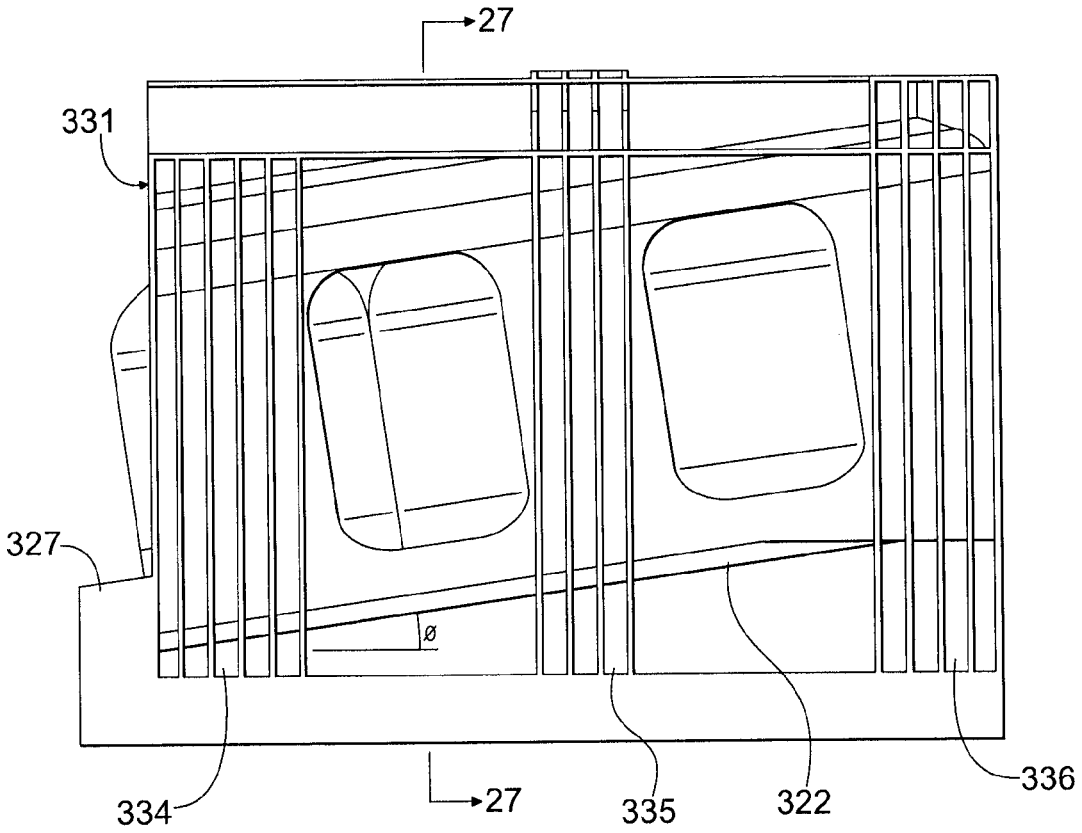
FIG. 22 is a side elevation view of the storage unit of FIG. 20.

Referring to FIGS. 16-18, a storage assembly 210 in accordance with another embodiment of the invention will be described in greater detail. The storage assembly 210 of the present embodiment is preferably configured to store storable members in an upright or vertical orientation as shown in the figures. That is, the storable members are oriented with their largest dimension upright, perpendicular to the support surface or vertical. The storage assembly 210 generally includes a plurality of stacked storage units 220 supported between upper and lower frame units 250 (only the lower frame unit shown). Each storage unit 220 of the present exemplary embodiment includes a generally planar support surface 222 enclosed by opposed side walls 224 and 226, a rear wall 225 and a front wall 227. The rear wall 225 may be omitted or lower than the other walls to facilitate loading. The support surface 222, rear wall 225 and front wall 227 extend latitudinally between opposed front posts 234 and rear posts 236. A support rail 229 may be provided between the front posts 234 to provide extra support to the front wall 227. The side wall 224 extends between one pair of front and rear posts 234, and 236 and the other side wall 226 extends between the other pair of front and rear posts 234 and 236. The platform and walls 224 and 226 are attached to the posts 234, 236 such that they are at angle ø relative to the horizontal, sloping downward from the rear to the front.

The support surface 222 is divided by one or more dividing walls 230 extending between the rear wall 225 and the front wall 227 into storage areas 232. In the illustrated embodiment, there are three dividing walls 230 defining four storage areas 232. Each storage area 232 has an opening or open area 231 adjacent to the front wall 227. Based on the slope of the support surface 222, the opening 231 is at an angle $\alpha$ relative to the support surface 222. The angle $\alpha$ preferably equals 90°−ø. Each storage area 232 has a width preferably slightly wider than the intended storable members. The dividing walls 230 may be adjustable to adjust the widths or change the number of storage areas 232.

The frame units 250 are illustrated with a pair of planar platforms 252 and 254 with a plurality of posts 256 therebetween. The lowest storage unit 220 sits on the upper platform 252. The posts 234 and 236 of adjacent storage units 220 preferably have interconnecting members, for example, tongues 235, for stacking the storage units 220 on top of one another. As shown in the figures, a stop mechanism may be provided on the storage units 220 to prevent the storable members from sliding out of the storage areas 232. In the illustrated embodiment, a stop member 240 is supported by brackets 242, 244 attached to the front wall 227' of the storage unit 220 stacked above. In the locked position shown in FIG. 17, the stop member 240 contacts the storable member (shown in phantom) such that the storable member is retained by the front wall 227 and the stop member 240. To remove a storable member, the stop member 240 is moved to an unlocked position as shown in FIG. 18. such that a portion of the storable member is clear thereof. In the preferred embodiment, the front wall 227 is preferably at an obtuse angle $\beta$ relative to the support surface 222 such that upon movement of the stop member 240 to the unlocked position, the storable member (shown in phantom) may tilt forward out the opening 231 as shown in FIG. 18, thereby easing removal of the storable member.

Referring to FIGS. 19-28, a storage assembly 310 in accordance with another embodiment of the invention will be described in greater detail. The storage assembly 310 of the present embodiment is preferably configured to store storable members in an upright or vertical orientation as shown in the figures. That is, the storable members are oriented with their largest dimension upright, perpendicular to the support surface or vertical. The storage assembly 310 generally includes a plurality of stacked storage units 320. Each storage unit 320 of the present exemplary embodiment includes a generally planar support surface 322 enclosed by opposed side walls 324 and 326 and a front wall 327. The support surface 322 and front wall 327 extend latitudinally between opposed front posts 334, mid posts 335 and rear posts 336. A rear rail 325 preferably extends between the rear posts 336 to support a rear portion of the support surface 322. A stop member 319 may be positioned along the rail 325 aligned with each storage area 332 to reduce the likelihood that a storable member may inadvertently exit through the rear of the storage unit 320. The side wall 324 extends between one pair of front and rear posts 334, and 336 with the mid post 335 therealong and the other side wall 326 extends between the other pair of front and rear posts 334 and 336 with the mid post 335 therealong. The platform and walls 324 and 326 are attached to the posts 334, 335, 336 such that they are at angle ø relative to the horizontal, sloping downward from the rear to the front.

A mid wall 329 may extend from front to back between the side walls 324 and 326. The side walls 324 and 326 and the mid wall 329 support a top structure 350. Front, mid and rear posts 334', 335' and 336' may depend below the mid wall 329 to provide support for the support surface 322. As illustrated, the walls 324, 326, 327, 329, posts 334, 334', 335, 335', 336, 336', rails 325 and top structure 350 may be manufactured as ribbed structures to provide a light weight, rigid structure. Additional ribs 321, see FIG. 24, may be provided below the support surface 322 for added strength. Various through holes 323 may also be provided to reduce weight, increase visibility and/or facilitate clean out. The structures may be formed as continuous members, as interconnected individual components and/or as interconnected subassemblies.

Referring to FIGS. 19, 20, 23 and 27, the top surface 352 of the top structure 350 preferably defines shoulders 354 and 356 and a recess 358 extending from front to back. The shoulders 354 and 356 are each configured to receive a respective set of front, mid and rear posts 334, 335, 336 and the recess 358 is configured to receive the front, mid and rear posts 334', 335', 336' from a storage unit 320 positioned thereon. Interlocking ribs 360, 362 or the like are preferably provided between the posts 334, 334', 335, 335', 336, 336' and the shoulders 354, 356 and the recess 358 to longitudinally lock the adjacent storage units 320.

Figure 26:
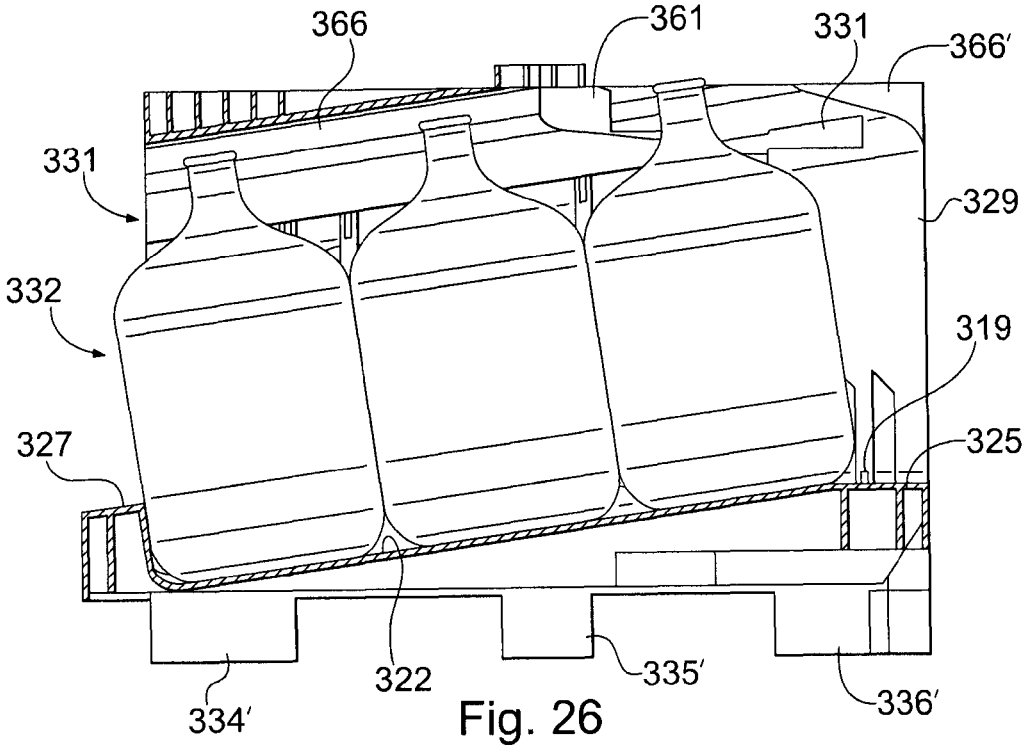
FIG. 26 is a cross-sectional view similar to FIG. 25 with the storable members in position.
Figure 27:
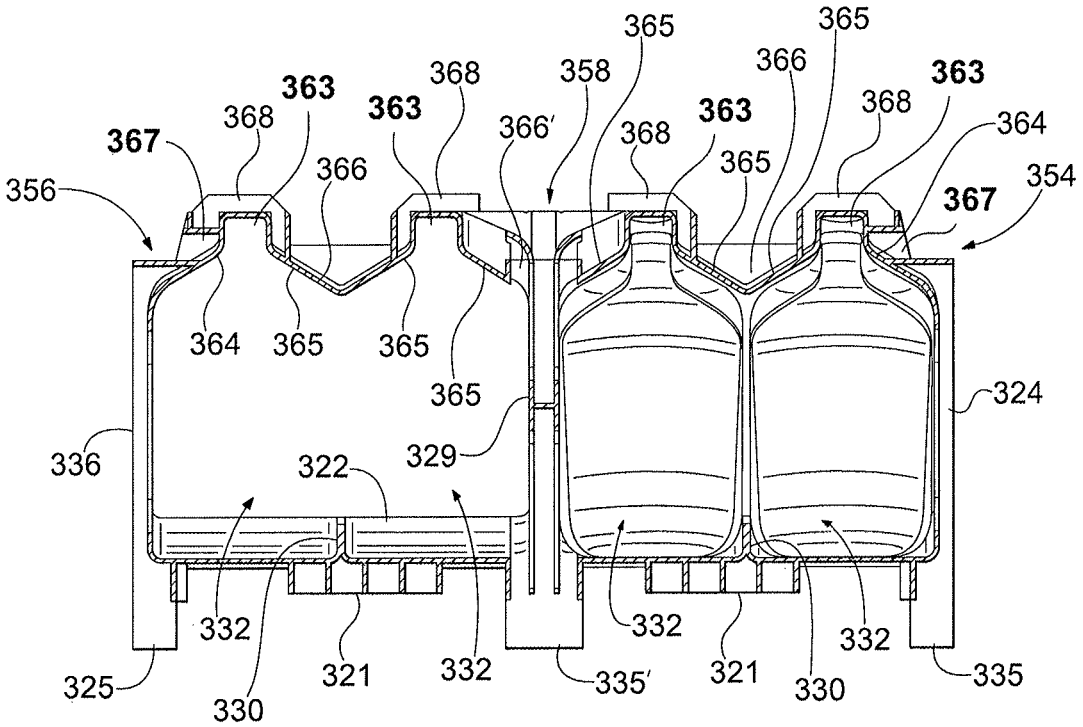
FIG. 27 is a cross-sectional view along the line 27-27 of FIG. 22.
Figure 28:
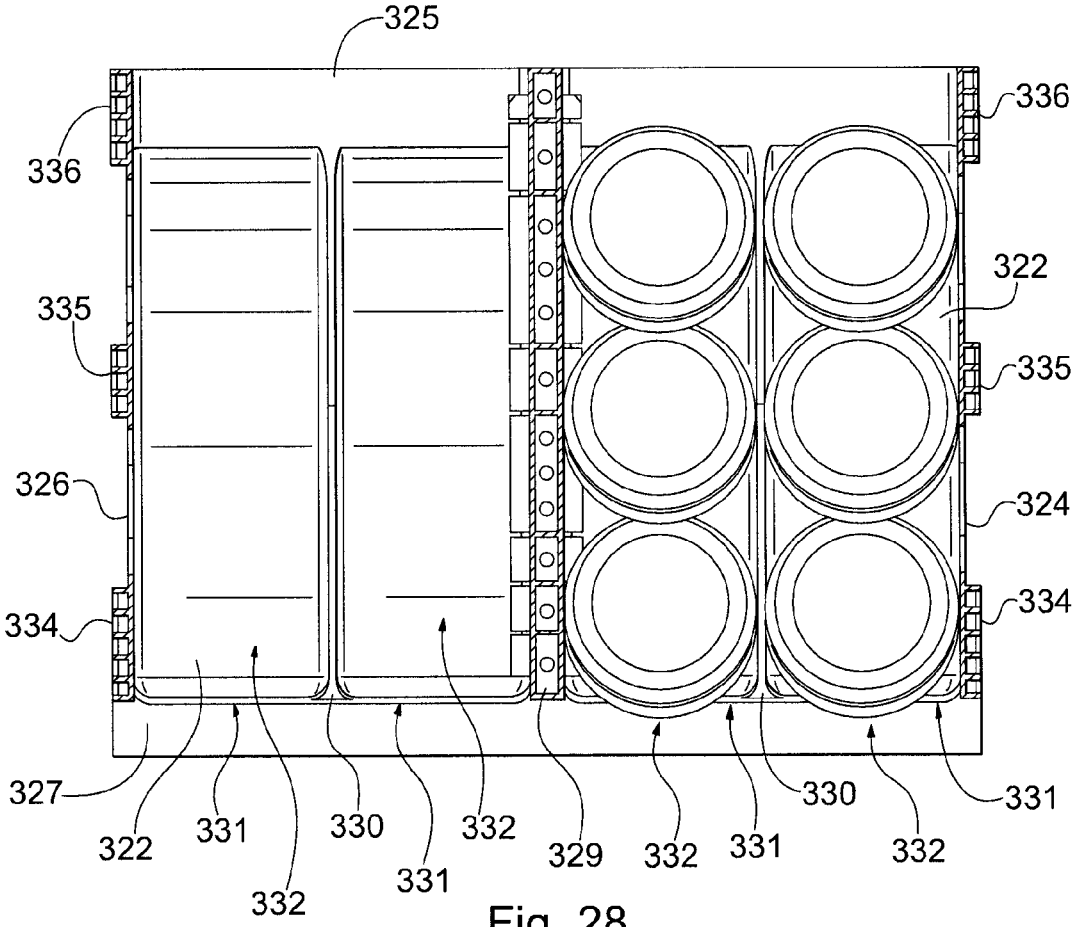
FIG. 28 is a cross-sectional view along the line 28-28 in FIG. 21.

Referring to FIGS. 19-21 and 25-27, the support surface 322 is divided into storage areas 322 by the mid wall 329 and one or more dividing walls 330 extending from the front wall 327 toward the rear rail 325. In the illustrated embodiment, there are two dividing walls 330 whereby four storage areas 332 are defined. The support surface 322 may be formed as a continuous surface with the walls 329, 330 extending up therefrom or the support surface 322 may only extend within each storage area 322 and be formed integral with the walls 329, 330 as illustrated in FIG. 27.

Figure 23:
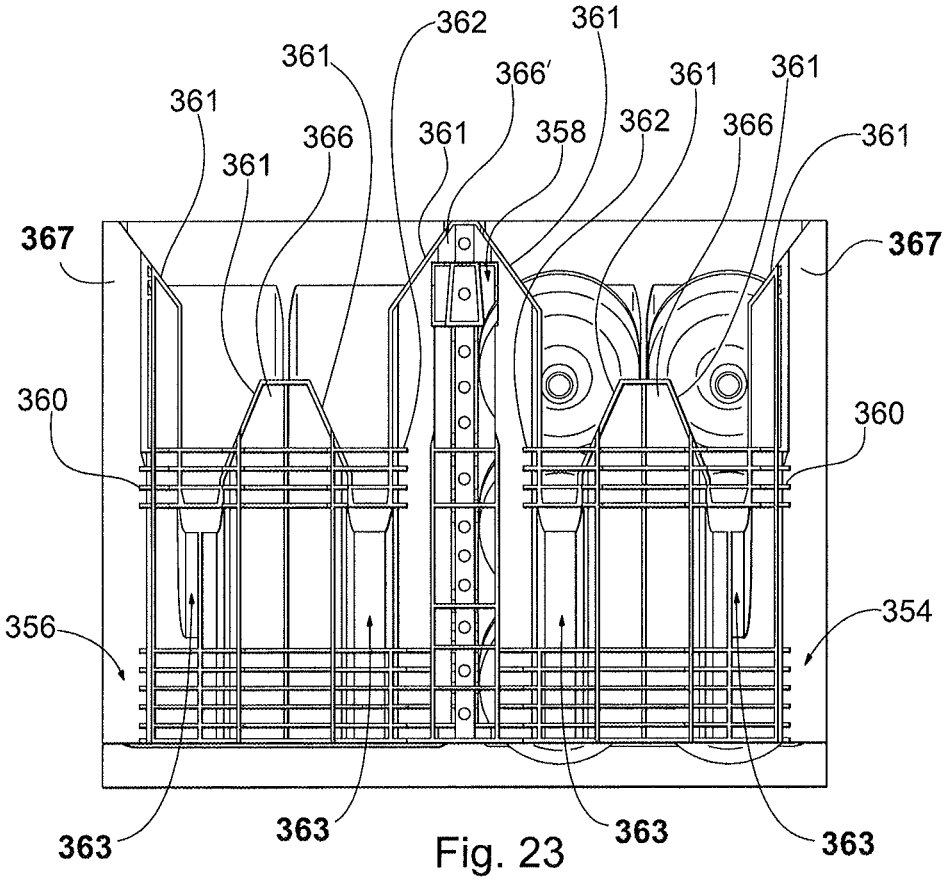
FIG. 23 is a top plan view of the storage unit of FIG. 20.
Figure 24:
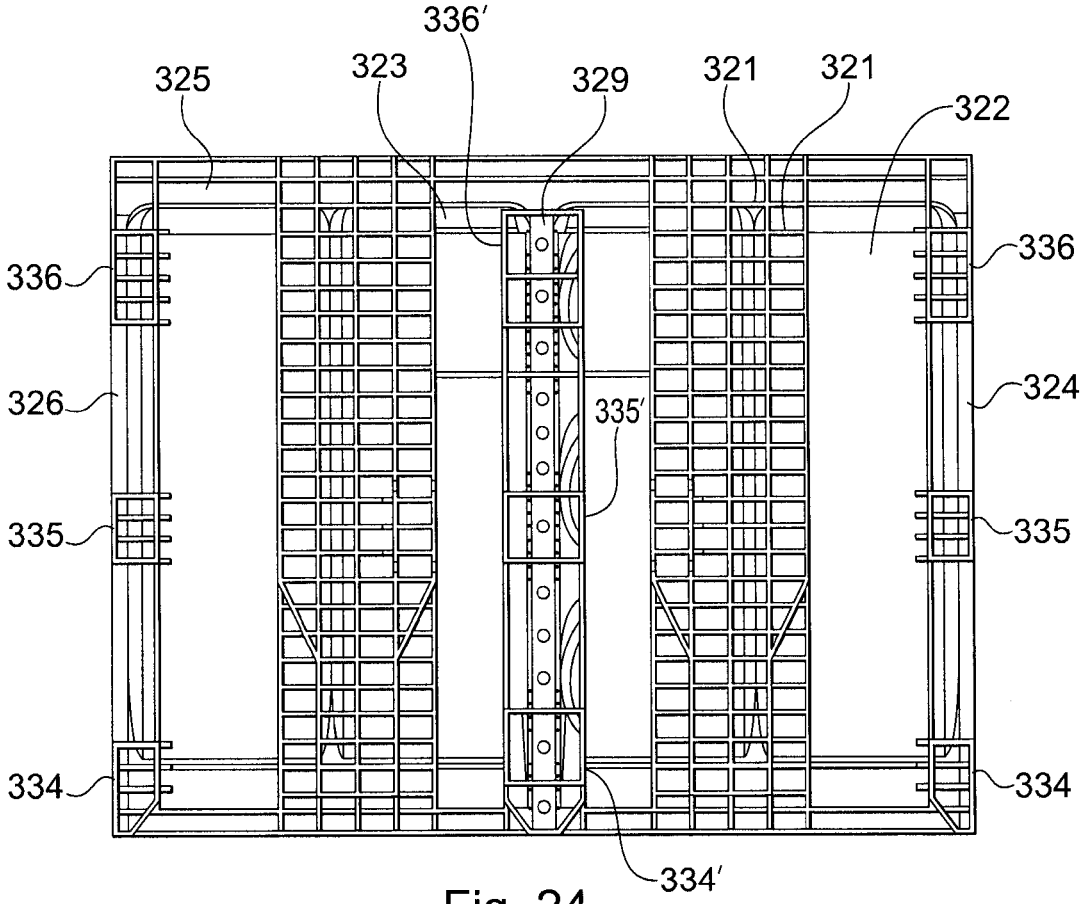
FIG. 24 is a bottom plan view of the storage unit of FIG. 20.
Figure 25:
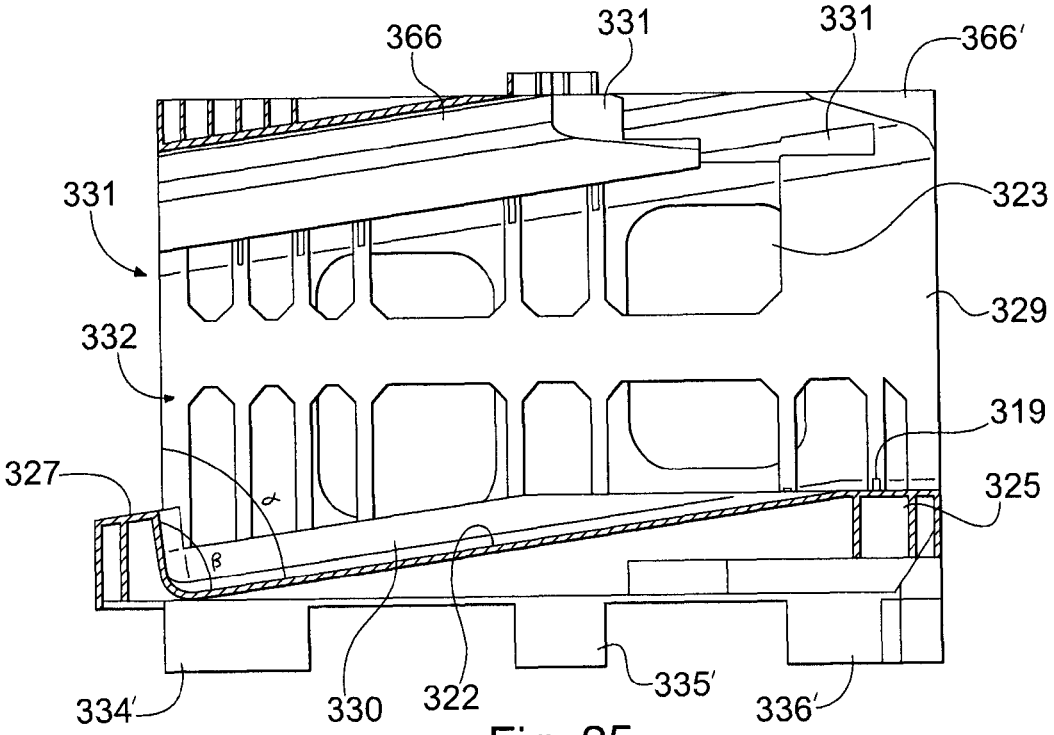
FIG. 25 is a cross-sectional view along the line 25-25 of FIG. 21 with the storable members removed.

As shown in FIGS. 19-21, 23 and 27, the top structure 350 preferably defines alignment grooves 363 configured to engage a top portion of the storable members. Each alignment groove 363 is aligned with a respective storage area 332. In the illustrated embodiment, the alignment grooves 363 are defined by a plurality of rails 366, 366', 367 extending from the front toward the rear of the storage unit 320. The rails 366, 366', 367 are attached by bridge portions 368. Outside rails 367 each extend along respective side walls 324, 326 and define a contoured surface 364 which forms a portion of the outside grooves 363. The rails 366 have a substantially v-shape such that the rails 366 define two contoured surfaces 365, each one defining a portion of a respective groove 363. The central rail 366' defines two contoured surfaces 365 and interconnects with the mid wall 329. The configuration of the contoured surfaces 364, 365 and the grooves 363 preferably complements the shape of the upper portion of the storable member. As shown in FIG. 23, the rear portion of each rail 366, 366', 367 defines tapered surfaces 361 which funnel toward the grooves 363.

Each storage area 332 has an opening or open area 331 adjacent to the front wall 327. Based on the slope of the support surface 322, the opening 331 is at an angle $\alpha$ relative to the support surface 322. The angle $\alpha$ preferably equals 90°−ø. Each storage area 332 has a width preferably slightly wider than the intended storable members. In the preferred embodiment, the front wall 327 is preferably at an angle $\beta$ of 90 degrees or more relative to the support surface 322 such that the storable members are supported in a position wherein the storable member tilts forward toward the opening 331 as shown in FIG. 26, thereby easing removal of the storable member.

The storage assemblies described herein may be manufactured from various materials, including but not limited to plastics, metals and composite materials.

Although illustrated and described above with reference to certain specific embodiments, the present invention is nevertheless not intended to be limited to the details shown. Rather, various modifications may be made in the details within the scope and range of equivalents of the claims and without departing from the invention.

What is claimed:

1. A gravity feed storage unit for stacking, storing, transporting and dispensing bottles, the storage unit having a front and a rear, the storage unit comprising:

a forklift-sortable modular structure, the modular structure comprising:

a top structure;

a first side wall;

a second side wall opposite the first side wall; and a support structure defining at least one storage area including a support surface to support at least one bottle in an upright position;

the top structure, first side wall, second side wall and support structure collectively defining a rear opening that facilitates rear loading of the at least one bottle in an upright position through the rear of the storage unit, and a front opening that facilitates dispensing of the at least one bottle in an upright position from the front of the storage unit, the support surface defining an axis that is at an acute angle ø with respect to a horizontal plane, the top structure defining a plurality of rails extending longitudinally from the front to the rear of the storage unit, the rails defining at least one bottle-neck shaped alignment groove inside the storage area that is configured to engage and complement the shape of a bottle neck of a bottle placed in an upright position in the storage area, the rails of the top structure also defining tapered surfaces at inner portions of the rails, the tapered surfaces funneling toward the at least one alignment groove, the storage unit further comprising a plurality of posts that extend below the support structure, the posts defining a first channel that extends between the posts and beneath the at least one storage area, the plurality of rails being interconnected by bridge portions projecting upwardly from the storage area, the bridge portions being separated from one another by a second channel that extends between the bridge portions and above the at least one storage area, the first channel exposed on at least one side of the storage unit to receive a forklift tine or the like beneath the at least one storage area, and the second channel exposed on the at least one side of the storage unit to receive a forklift tine or the like above the at least one storage area, the storage unit being positionable in a stacked condition on top of a secondary storage unit that is configured identically to said storage unit, wherein, in a stacked condition, the first channel of the storage unit is alignable with the second channel of said secondary storage unit to allow a forklift tine or the like to be inserted between the storage units.

2. The storage unit according to claim 1 wherein the front opening extends in a plane at an acute angle $\alpha$ with respect to the axis of the support surface.

3. The storage unit according to claim 2, wherein the plurality of posts extend parallel to the plane of the front opening.

4. The storage unit according to claim 3 wherein each of the posts has a base surface extending perpendicular to the plane of the front opening.

5. The storage unit according to claim 4, wherein the base surfaces of each of the posts extend in a common plane.

6. The storage unit according to claim 4 wherein the base surfaces of the posts are configured to be supported on a base assembly or on the secondary storage unit.

7. The storage unit according to claim 3, wherein the storage area extends from the front to the rear and the plurality of posts includes front posts adjacent the front of the storage area and rear posts adjacent the rear of the storage area.

8. The storage unit according to claim 1 wherein the acute angle $\alpha$ equals 90°−ø.

9. The storage unit according to claim 1 wherein the support structure includes a front wall extending laterally across the at least one storage area adjacent the front opening, the front wall extending at an angle of 90 degrees or more relative to the support surface axis.

10. A storage assembly including at least the storage unit and the secondary storage unit according to claim 1 wherein the secondary storage unit is stacked upon the storage unit.

11. The storage unit according to claim 1, wherein the top structure comprises a plurality of ribs for interlocking engagement with an adjacent storage unit to longitudinally lock the storage unit with the adjacent storage unit.

12. The storage unit according to claim 1 further comprising a front wall that forms an obtuse angle $\beta$ with the support structure.

* * * * *